US007839368B2

(12) United States Patent
Chen et al.

(10) Patent No.: US 7,839,368 B2
(45) Date of Patent: Nov. 23, 2010

(54) APPARATUS AND METHOD FOR GENERATING OVERDRIVING VALUES FOR USE IN LCD OVERDRIVING

(75) Inventors: Ming-Yeong Chen, Hsinhua (TW); Kuo-Hsiang Hung, Hsinhua (TW); Yu-Chu Yang, Hsinhua (TW)

(73) Assignee: Himax Technologies Limited, Tainan County (TW)

( * ) Notice: Subject to any disclaimer, the term of this patent is extended or adjusted under 35 U.S.C. 154(b) by 852 days.

(21) Appl. No.: 11/485,242

(22) Filed: Jul. 11, 2006

(65) Prior Publication Data

US 2007/0222726 A1 Sep. 27, 2007

(30) Foreign Application Priority Data

Mar. 21, 2006 (TW) ..... 95109592 A

(51) Int. Cl.
*G09G 3/36* (2006.01)

(52) U.S. Cl. ..... 345/87; 345/690; 345/77

(58) Field of Classification Search ..... 345/690, 345/77, 87

See application file for complete search history.

(56) References Cited

U.S. PATENT DOCUMENTS 4,755,958 A * 7/1988 Mizuhara ..... 702/133
6,853,259 B2 * 2/2005 Norman et al. ..... 331/66
6,927,784 B2 * 8/2005 Matsuda et al. ..... 345/690
7,038,647 B2 * 5/2006 Shigeta et al. ..... 345/89
7,050,114 B2 * 5/2006 Stessen et al. ..... 348/679
7,091,725 B2 * 8/2006 Horsky et al. ..... 324/605
7,136,076 B2 * 11/2006 Evanicky et al. ..... 345/600
7,221,792 B2 * 5/2007 Matsuda et al. ..... 382/167
7,277,076 B2 * 10/2007 Shiomi et al. ..... 345/89
2003/0063221 A1 * 4/2003 Stessen et al. ..... 348/678
2003/0179175 A1 * 9/2003 Shigeta et al. ..... 345/101
2006/0103682 A1 * 5/2006 Kunimori et al. ..... 345/690
2006/0219700 A1 * 10/2006 Chen et al. ..... 219/497
2007/0052735 A1 * 3/2007 Chou ..... 345/690
2007/0086807 A1 * 4/2007 Kuma et al. ..... 399/121

* cited by examiner

*Primary Examiner*—Bipin Shalwala
*Assistant Examiner*—Afroza Y Chowdhury
(74) *Attorney, Agent, or Firm*—J.C. Patents

(57) ABSTRACT

An apparatus and a method for generating overdriving values are provided, used to generate the overdriving values for displaying image data. The apparatus for generating overdriving values includes an outside environment sensor unit and an adjustment module. The outside environment sensor unit is for detecting at least an environment parameter. The adjustment module, electrically coupled with the outside environment sensor unit, receives environment parameters, generates and outputs the adjustment overdriving values according to the environment parameters. The above-mentioned environment parameters include at least one of a frame rate and a temperature.

10 Claims, 8 Drawing Sheets

LUT16(RED)

| INITIAL GRAYSCALE VALUE \ TARGET GRAYSCALE VALUE | 0 | 15 | 31 | 47 | 63 | 79 | 95 | 111 | 127 | 143 | 159 | 175 | 191 | 207 | 223 | 239 | 255 |
|---|---|---|---|---|---|---|---|---|---|---|---|---|---|---|---|---|---|
| 0 | 0 | 18 | 40 | 60 | 87 | 110 | 138 | 161 | 179 | 198 | 212 | 225 | 235 | 244 | 252 | 255 | 255 |
| 15 | 0 | 15 | 33 | 59 | 82 | 104 | 132 | 153 | 176 | 193 | 208 | 222 | 233 | 243 | 251 | 255 | 255 |
| 31 | 0 | 14 | 31 | 52 | 71 | 97 | 117 | 140 | 161 | 184 | 200 | 215 | 228 | 239 | 248 | 255 | 255 |
| 47 | 0 | 12 | 30 | 47 | 71 | 88 | 111 | 132 | 154 | 174 | 193 | 209 | 224 | 237 | 247 | 255 | 255 |
| 63 | 0 | 12 | 27 | 44 | 63 | 83 | 103 | 125 | 148 | 168 | 187 | 206 | 219 | 234 | 245 | 254 | 255 |
| 79 | 0 | 8 | 26 | 41 | 58 | 79 | 99 | 120 | 140 | 163 | 182 | 202 | 217 | 232 | 244 | 254 | 255 |
| 95 | 0 | 6 | 26 | 39 | 55 | 73 | 95 | 114 | 134 | 158 | 176 | 198 | 214 | 230 | 243 | 253 | 255 |
| 111 | 0 | 4 | 25 | 37 | 51 | 68 | 91 | 111 | 133 | 152 | 172 | 194 | 211 | 228 | 243 | 253 | 255 |
| 127 | 0 | 4 | 23 | 34 | 49 | 65 | 84 | 104 | 127 | 150 | 168 | 190 | 208 | 225 | 240 | 252 | 255 |
| 143 | 0 | 4 | 21 | 31 | 47 | 61 | 79 | 98 | 119 | 143 | 164 | 185 | 204 | 225 | 238 | 251 | 255 |
| 159 | 0 | 0 | 21 | 31 | 45 | 59 | 76 | 93 | 114 | 136 | 159 | 180 | 201 | 220 | 236 | 250 | 255 |
| 175 | 0 | 0 | 20 | 30 | 43 | 54 | 71 | 88 | 108 | 129 | 150 | 175 | 196 | 216 | 234 | 248 | 255 |
| 191 | 0 | 0 | 18 | 29 | 39 | 51 | 66 | 83 | 100 | 121 | 141 | 167 | 191 | 212 | 230 | 245 | 255 |
| 207 | 0 | 0 | 18 | 26 | 36 | 47 | 61 | 76 | 92 | 113 | 131 | 158 | 180 | 207 | 226 | 244 | 255 |
| 223 | 0 | 0 | 16 | 24 | 33 | 43 | 57 | 69 | 84 | 103 | 122 | 148 | 171 | 199 | 223 | 240 | 255 |
| 239 | 0 | 0 | 13 | 22 | 29 | 39 | 47 | 59 | 74 | 90 | 108 | 132 | 157 | 186 | 213 | 239 | 255 |
| 255 | 0 | 0 | 9 | 17 | 24 | 29 | 38 | 45 | 55 | 67 | 80 | 98 | 121 | 152 | 185 | 222 | 255 |

INITIAL GRAYSCALE VALUE

| | 0 | 15 | 31 | 47 | 63 | 79 | 95 | 111 | 127 | 143 | 159 | 175 | 191 | 207 | 223 | 239 | 255 |
|---|---|---|---|---|---|---|---|---|---|---|---|---|---|---|---|---|---|
| 0 | 0 | 0.04 | −0.01 | 0 | −0.005 | 0.002 | 0.008 | 0.005 | 0.007 | 0.005 | 0.012 | 0.008 | 0.011 | 0.005 | 0.002 | −2E−16 | −2E−16 |
| 15 | 0 | 0 | −0.02 | 6E−04 | 0.002 | 0.004 | −0.004 | 0 | −0.004 | 0.002 | 0.008 | 0.005 | 0.005 | 0.005 | 0.005 | −0.002 | −2E−16 |
| 31 | 0 | −0.008 | 0 | −0.005 | 0 | −0.01 | −0.002 | −6E−04 | −0.004 | 0.002 | 0.005 | 0.013 | 0.007 | 0.004 | 0.005 | −0.005 | −2E−16 |
| 47 | 0 | −0.012 | 0.002 | 0 | 0.017 | 0.008 | −0.003 | 0 | 0.002 | 0.007 | 0.008 | 0.011 | 0.003 | 0.01 | 0.005 | 0 | −2E−16 |
| 63 | 0 | −0.013 | −0.01 | 0 | 0 | −0 | −1E−16 | 6E−04 | −0.005 | −0.003 | 0.011 | 0.011 | 0.011 | 0.005 | 0.008 | −0.002 | −2E−16 |
| 79 | 0 | −0.008 | −0.01 | 0.002 | −0.003 | 0 | 0.004 | 0.002 | 0.005 | 0.003 | 0.014 | 0.008 | 0.005 | 0.005 | 0.005 | 0.003 | −2E−16 |
| 95 | 0 | −0.017 | −0.01 | 6E−04 | 0 | 0.004 | 0 | 0.007 | 0.005 | 0.002 | 0.008 | 0.008 | 0 | 0.005 | 0.004 | 0 | −2E−16 |
| 111 | 0 | −0.025 | 0.002 | 0.008 | 0.014 | −0 | 0.001 | 0 | 0.011 | −0.006 | 0.003 | 0.008 | 0.005 | 0.002 | 0.008 | 0.005 | −2E−16 |
| 127 | 0 | −0.014 | 0.002 | 0.005 | −6E−04 | 0.002 | −0.005 | 0.002 | 0 | 0.004 | 0.004 | 0.011 | 0.002 | 0.005 | 0.002 | 0.002 | −2E−16 |
| 143 | 0 | −0.014 | −0.01 | 0.001 | 0.005 | 0.001 | 0.006 | 0.006 | 0.005 | 0 | 0.006 | 0.014 | 0.003 | −0.002 | 0.005 | 0.005 | −2E−16 |
| 159 | 0 | −0.005 | −0.01 | 0.008 | −6E−04 | 0 | 6E−04 | 6E−04 | −0.008 | −0.006 | −1E−16 | 0.007 | −0.004 | 0.008 | 0.005 | −2E−16 | −2E−16 |
| 175 | 0 | −0.001 | −0 | 0.003 | 6E−04 | 0.004 | 0.002 | 6E−04 | 0.002 | −0.006 | −1E−16 | 0 | −0.009 | −0.001 | 0.002 | 0.006 | −2E−16 |
| 191 | 0 | −0.001 | 6E−04 | −6E−04 | 0.007 | 0.003 | 0.004 | 0.003 | 0.004 | 0.003 | 0.01 | 0.006 | 0 | 6E−04 | −0 | −2E−16 | −2E−16 |
| 207 | 0 | −0.006 | 0.005 | 0.005 | 0.015 | 0.01 | 6E−04 | 0.003 | 0 | −0.002 | 0.004 | 0.007 | −6E−04 | 0 | 0.002 | 0 | −2E−16 |
| 223 | 0 | 0 | −0 | 0.006 | 0.011 | 0.011 | −0.002 | 0.002 | 0.001 | −0.002 | 0.004 | 0.001 | −0.009 | 6E−04 | 0 | 0 | −2E−16 |
| 239 | 0 | 0 | −0 | 6E−04 | 0.003 | −0 | 0.004 | −0.002 | −0.006 | −0.005 | 0.002 | −0.004 | −0.013 | −0.013 | −0 | 0 | −2E−16 |
| 255 | 0 | 0 | −0 | 0.003 | 0.012 | 0.005 | −0.003 | 0.002 | 0 | 0.002 | 0.002 | −0.003 | −0.022 | −0.028 | −0.03 | −0.015 | −2E−16 |

TARGET GRAYSCALE VALUE

FIG. 8

INITIAL GRAYSCALE VALUE

| | 0 | 15 | 31 | 47 | 63 | 79 | 95 | 111 | 127 | 143 | 159 | 175 | 191 | 207 | 223 | 239 | 255 |
|---|---|---|---|---|---|---|---|---|---|---|---|---|---|---|---|---|---|
| 0 | 0 | 6E−04 | 4E−04 | −0.001 | −0.003 | −0.002 | −2E−04 | −4E−04 | 0.001 | 0.003 | 0.009 | 0.012 | 0.01 | 0.009 | 0.007 | 4E−04 | −3E−16 |
| 15 | 0 | 0 | 2E−04 | −8E−04 | −0.002 | −0.002 | −2E−04 | −4E−04 | 1E−03 | 0.003 | 0.008 | 0.011 | 0.009 | 0.008 | 0.007 | 4E−04 | −3E−16 |
| 31 | 0 | −6E−04 | 0 | −4E−04 | −0.002 | −0.001 | −1E−04 | −3E−04 | 8E−04 | 0.003 | 0.007 | 0.01 | 0.008 | 0.007 | 0.006 | 3E−04 | −3E−16 |
| 47 | 0 | −0.001 | −2E−04 | 0 | −8E−04 | −9E−04 | −1E−04 | −3E−04 | 7E−04 | 0.002 | 0.006 | 0.009 | 0.008 | 0.007 | 0.006 | 3E−04 | −3E−16 |
| 63 | 0 | −0.002 | −4E−04 | 0.0004 | 0 | −4E−04 | −7E−05 | −2E−04 | 6E−04 | 0.002 | 0.005 | 0.008 | 0.007 | 0.006 | 0.005 | 3E−04 | −2E−16 |
| 79 | 0 | −0.002 | −6E−04 | 0.0008 | 8E−04 | 0 | −3E−05 | −1E−04 | 4E−04 | 0.001 | 0.004 | 0.007 | 0.006 | 0.005 | 0.005 | 3E−04 | −2E−16 |
| 95 | 0 | −0.003 | −8E−04 | 0.0011 | 0.002 | 4E−04 | 0 | −6E−05 | 3E−04 | 0.001 | 0.003 | 0.006 | 0.005 | 0.005 | 0.004 | 2E−04 | −2E−16 |
| 111 | 0 | −0.004 | −1E−03 | 0.0015 | 0.002 | 9E−04 | 3E−05 | 0 | 1E−04 | 7E−04 | 0.003 | 0.004 | 0.004 | 0.004 | 0.004 | 2E−04 | −2E−16 |
| 127 | 0 | −0.004 | −0.001 | 0.0019 | 0.003 | 0.001 | 3E−07 | 6E−05 | 0 | 4E−04 | 0.002 | 0.003 | 0.003 | 0.003 | 0.003 | 2E−04 | −2E−16 |
| 143 | 0 | −0.005 | −0.001 | 0.0023 | 0.004 | 0.002 | 1E−04 | 1E−04 | −1E−04 | 0 | 9E−04 | 0.002 | 0.003 | 0.003 | 0.003 | 2E−04 | −1E−16 |
| 159 | 0 | −0.005 | −0.002 | 0.0027 | 0.005 | 0.002 | 1E−04 | 2E−04 | −3E−04 | −4E−04 | 0 | 0.001 | 0.002 | 0.002 | 0.002 | 1E−04 | −1E−16 |
| 175 | 0 | −0.006 | −0.002 | 0.003 | 0.005 | 0.003 | 2E−04 | 3E−04 | −4E−04 | −7E−04 | −9E−04 | 0 | 8E−04 | 0.001 | 0.002 | 1E−04 | −1E−16 |
| 191 | 0 | −0.006 | −0.002 | 0.0034 | 0.006 | 0.003 | 2E−04 | 3E−04 | −6E−04 | −0.001 | −0.002 | −0.001 | 0 | 7E−04 | 0.001 | 8E−05 | −8E−17 |
| 207 | 0 | −0.007 | −0.002 | 0.0038 | 0.007 | 0.004 | 2E−04 | 4E−04 | −7E−04 | −0.001 | −0.003 | −0.002 | −8E−04 | 0 | 5E−04 | 5E−05 | −6E−17 |
| 223 | 0 | −0.008 | −0.002 | 0.0042 | 0.008 | 0.004 | 3E−04 | 5E−04 | −8E−04 | −0.002 | −0.003 | −0.003 | −0.002 | −7E−04 | 0 | 3E−05 | −4E−17 |
| 239 | 0 | −0.008 | −0.003 | 0.0046 | 0.009 | 0.004 | 3E−04 | 5E−04 | −1E−03 | −0.002 | −0.004 | −0.004 | −0.003 | −0.001 | −5E−04 | 0 | −2E−17 |
| 255 | 0 | −0.009 | −0.003 | 0.0049 | 0.009 | 0.005 | 3E−04 | 6E−04 | −0.001 | −0.003 | −0.005 | −0.006 | −0.003 | −0.002 | −0.001 | −3E−05 | 0 |
| SLOPE | 0 | −4E−05 | −1E−05 | 2E−05 | 5E−05 | 3E−05 | 2E−06 | 4E−06 | −9E−06 | −2E−05 | −5E−05 | −7E−05 | −5E−05 | −4E−05 | −3E−05 | −2E−06 | 1E−18 |

TARGET GRAYSCALE VALUE

FIG. 9

APPARATUS AND METHOD FOR GENERATING OVERDRIVING VALUES FOR USE IN LCD OVERDRIVING

CROSS-REFERENCE TO RELATED APPLICATION

This application claims the priority benefit of Taiwan application serial no. 95109592, filed on Mar. 21, 2006. All disclosure of the Taiwan application is incorporated herein by reference.

BACKGROUND OF THE INVENTION

1. Field of Invention

The present invention relates to a circuit for processing display data, and more particularly to an apparatus and a method for generating overdriving values for use in LCD overdriving.

2. Description of the Related Art

When a flat panel display such as an LCD is displaying a frame image, each pixel within the display is applied with a driving voltage to rotate the liquid crystal molecules, which changes the light transmissivity of the pixel to produce expected brightness and color. The rotation speed and rotation angle are related to the applied driving voltage; the larger the driving voltage, the higher the rotation speed is and the larger the rotation angle after reaching a stable state is. To operate the display at a frame rate of 30 fps or higher, for example, the pixel needs to be applied with an overdriving voltage, so as to speed the rotation of the liquid crystal molecules and the transition to next frame image. To this end, a look-up table (LUT) is used to find out an overdriving value corresponding to the overdriving voltage for application to the pixel according to its initial grayscale value and target grayscale value for the next frame image.

FIG. 1 is a block diagram of a conventional apparatus for generating overdriving value corresponding to an overdriving voltage for application to a pixel of the display and FIG. 2 is an LUT used in the conventional apparatus as shown in FIG. 1. Refer to FIGS. 1 and 2, an LUT storage 15 receives the target grayscale value $V_T$ and the initial grayscale value $V_S$ stored in a frame buffer 13 and outputs the overdriving value $V_{OD}$ corresponding to the overdriving voltage of the pixel for application to the pixel to speed the frame transition. For example, in FIG. 2, if the initial grayscale value $V_S$ is 111 and the target grayscale value $V_T$ for the next frame image is 127, the corresponding overdriving value $V_{OD}$ of 133 is found out.

However, such a conventional LUT ignores two factors, that is, frame rate and temperature, which would affect accuracy of the overdriving values and the credibility of the LUT. In a computer game demanding a display operated at a frame rate of 120 fps, for example, using such a conventional LUT to get the overdriving values often fails to rotate the liquid crystal molecules and transition to the next frame image timely and sufficiently, thus degrading the display quality.

Therefore, there is a need to improve the conventional apparatus, so the display quality can be effectively improved.

SUMMARY OF THE INVENTION

An objective of the present invention is to provide an apparatus for generating overdriving values of display data, which correspond to overdriving voltages for application to a flat panel display such as an LCD, wherein the apparatus is capable of adjusting the overdriving values further according to frame rate and/or temperature, so as to improve the display quality.

Another objective of the present invention is to provide a method for generating overdriving values of display data, which correspond to overdriving voltages for application to a flat panel display such as an LCD display, which can improve the display quality even at a varying frame rate and temperature.

The present invention provides an apparatus for generating overdriving values to adjust the overdriving values used for displaying image data. The apparatus for generating overdriving values includes an outside environment sensor unit and an adjustment module. The outside environment sensor unit is for detecting at least one environment parameter, while the adjustment module is electrically coupled with the outside environment sensor unit to receive initial grayscale values and target grayscale values. The adjustment module outputs a corresponding adjustment overdriving value according to the environment parameter and a pair of initial grayscale value and target grayscale value.

In an embodiment of the present invention, the environment parameter includes at least one of the frame rate and temperature.

In an embodiment of the present invention, the outside environment sensor unit includes a heat-sensitive resistor, a linear resistor and an analog-to-digital converting unit. The heat-sensitive resistor and the linear resistor are connected in series between the output terminal of a voltage source and a grounding terminal; at an electrical coupling between the heat-sensitive resistor and the linear resistor, i.e. a node, an analog temperature measurement result is provided, which is afterwards converted into a digital result by the analog-to-digital converting unit and the digital result is provided to the adjustment module.

In an embodiment of the present invention, the adjustment module includes a storage unit and a calculation unit. The storage unit is for saving the coefficient set of a specific function and determining the output coefficients from the coefficient set according to the received initial grayscale value and target grayscale value. The calculation unit is electrically coupled with the storage unit to receive the output coefficients from the storage unit. The calculation unit further receives the coefficients and environment parameters, followed by substituting the received coefficients and environment parameters into the specific function for generating adjustment overdriving values.

In another embodiment of the present invention, the adjustment module includes a storage unit and a calculation unit, while the storage unit saves multiple slope values and outputs the slope value among the multiple slope values corresponding to a target grayscale value. The calculation unit is electrically coupled with the storage unit to receive the slope value output from the storage unit and calculates the coefficients for a specific function according to the received slope value and the pair of initial grayscale value and target grayscale value, followed by substituting the coefficients and environment parameters into the specific function for generating adjustment overdriving values.

The present invention further provides a method for generating overdriving values. The method includes detecting the outside environment parameters and determining adjustment overdriving values used for displaying the image data according to the environment parameters.

Wherein, the environment parameter includes at least one of frame rate and temperature.

In an embodiment of the present invention, the step to determine an adjustment overdriving value according to the environment parameter includes saving a set of the coefficients of a function used for adjusting original overdriving values, determining the coefficients taken from the set of the coefficients according to the received initial grayscale value and target grayscale value and then determining an original overdriving value according to the pair of initial grayscale value and target grayscale value. In addition, by substituting the taken coefficients and the environment parameter into the specific function, an adjustment overdriving value is produced.

In another embodiment of the present invention, the step to determine an adjustment overdriving value according to the environment parameter includes saving multiple slope values and obtaining a slope value corresponding to the received target grayscale value from the saved slope values. After that, the step includes calculating the coefficients of the specific function according to the received slope value and a pair of initial grayscale value and target grayscale value, determining an original overdriving value according to the pair of initial grayscale value and target grayscale value and finally substituting the coefficients and the environment parameter into the specific function to adjust the original overdriving value and produce an adjustment overdriving value.

In summary, the present invention adopts the frame rate and temperature as the environment parameters to further perform a calculation and adjustment on the original overdriving value, therefore, the present invention enables a flat panel display to have high-precision overdriving values even in a large-scale variation of frame rate and temperature, which makes the displayed frames more precisely controlled for high display quality.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve for explaining the principles of the invention.

FIG. 8 is an LUT for finding out the coefficient $b1_{S\text{-}T}$ according to an embodiment of the present invention.

FIG. 9 is an LUT with entries modified from the LUT of FIG. 8 and with a set of slopes obtained from the entries of the LUT of FIG. 8.

DESCRIPTION OF THE EMBODIMENTS

Figure 3A:
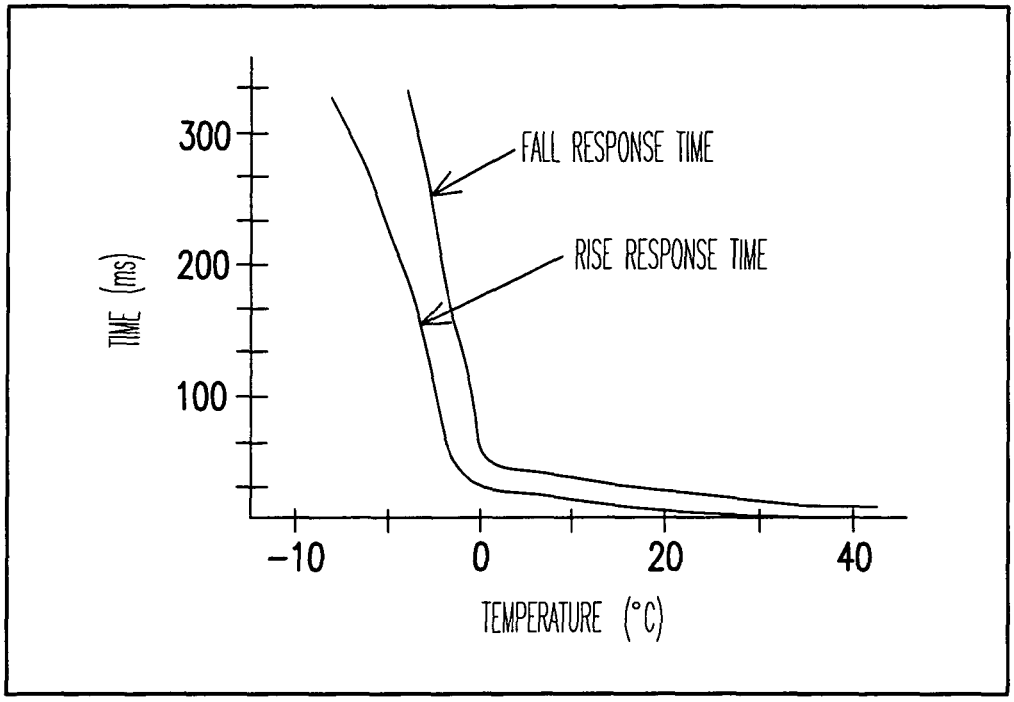
FIG. 3A is a diagram showing a rise response time and a fall response time as a function of temperature.

FIG. 3A is a diagram showing a rise response time and a fall response time as a function of temperature. Refer to FIG. 3A, the rise response time refers to a time period required for the frame transition from white to black, i.e., when the driving voltages of an display such as a TN-LCD display are increased from minimum to maximum; the fall response time refers to a time period required for the frame transition from black to white, i.e., when the driving voltages of the display are decreased from maximum to minimum. It can be seen from FIG. 3A, as the temperature drops, the rotation speed of the liquid crystal molecules slows down, which lengthens the rise response time and the fall response time, and an overdriving compensation, that is, the difference between the original overdriving value and the initial grayscale value, must be increased. On the contrary, as the temperature soars, the rotation speed of the liquid crystal molecules speeds up, which shortens the rise response time and the fall response time, and an overdriving compensation, that is, the difference between the original overdriving value and the initial grayscale value, must be decreased.

Figures 1, 2:
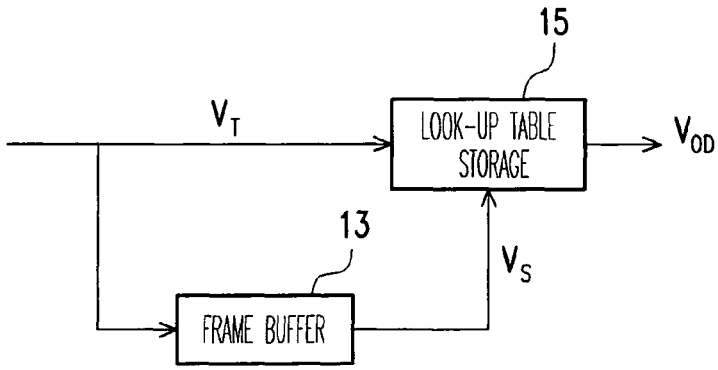
FIG. 1 (PRIOR ART)
FIG. 2 (PRIOR ART)
FIG. 1 is a block diagram of a conventional apparatus for generating an overdriving value, which corresponds to an overdriving voltage for application to a pixel of a flat panel display.
FIG. 2 is an LUT used in the apparatus as shown in FIG. 1.
Figure 3B:
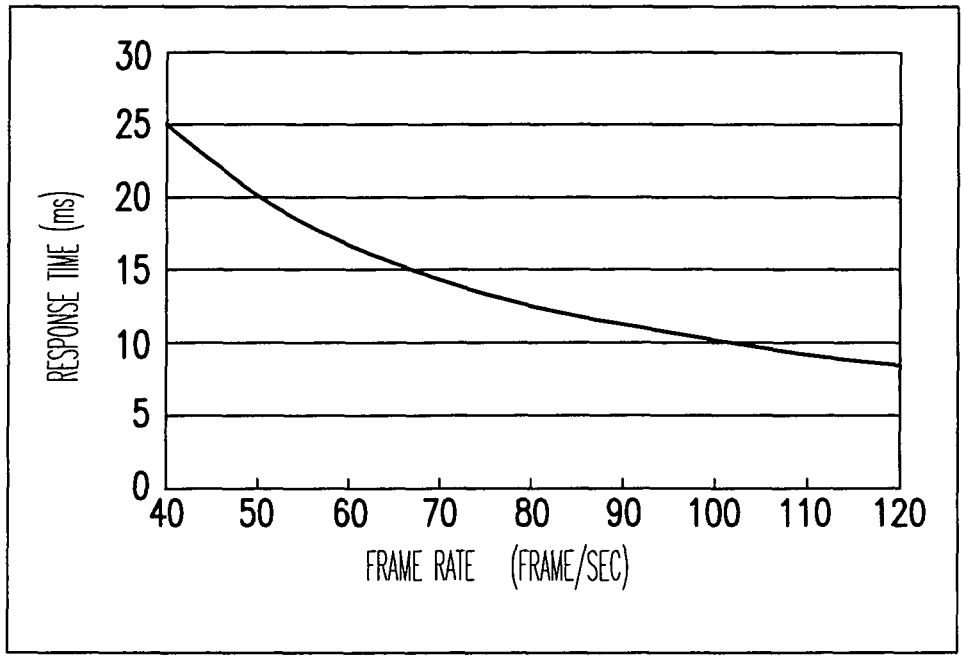
FIG. 3B is a diagram showing a response time as a function of frame rate.

Further, FIG. 3B is a diagram showing a response time as a function of frame rate. Refer to FIG. 3B, the response time refers to a time period required for the frame transition from white to black or from black to white. When the frame rate speeds up, for example, from 60 fps changed to 120 fps, the rotation speed of the liquid crystal molecules speeds up. At the point, if the overdriving values are still kept at the same level as those obtained from the LUT as shown in FIG. 2, the response time probably is not fast enough for the high frame rate, which makes the display quality during the frame transition unexpected. For example, in a computer game demanding a display operated at a high frame rate, the conventional apparatus may cause undesired frame transitions or artifacts.

Figure 4A:
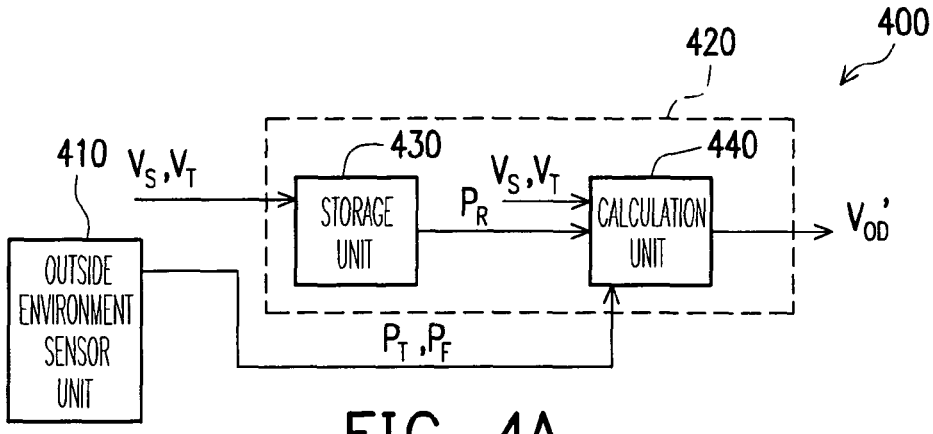
FIG. 4A is a block diagram of an apparatus for generating an overdriving value corresponding to an overdriving voltage for application to a pixel of a flat panel display according to an embodiment of the present invention.

FIG. 4A is a block diagram of an apparatus for generating an overdriving value corresponding to an overdriving voltage for application to a pixel of a flat panel display according to an embodiment of the present invention. Refer to FIG. 4A, the apparatus 400 includes an outside environment sensor unit 410 and an adjustment module 420, wherein the adjustment module 420 includes a storage unit 430 and a calculation unit 440. The outside environment sensor unit 410 detects environment parameters $P_F$ and $P_T$, and the adjustment module 420 outputs a modified overdriving value $V_{OD}'$ according to the initial grayscale value $V_S$ and the target grayscale value $V_T$ and further according to the environment parameters $P_F$ and $P_T$, wherein the environment parameter $P_F$ relates to frame rate, and the environment parameter $P_T$ relates to temperature. It is noted, however, the environment parameters $P_F$ and $P_T$ are not necessarily used together, that is to say, the apparatus 400 can also use only one environment parameter, $P_F$ or $P_T$, to produce the modified overdriving value $V_{OD}'$.

Furthermore, the storage unit 430 saves a set of coefficients for generating the modified overdriving values $V_{OD}'$ with a predefined function and selects a coefficient $P_R$ from the set according to the initial grayscale value $V_S$ and target grayscale value $V_T$. The calculation unit 440 is electrically coupled with the storage unit 430 to receive the coefficient $P_R$, substitutes the coefficient $P_R$ in the predefined function, and outputs the modified overdriving value $V_{OD}'$ according to the initial grayscale value $V_S$ and target grayscale value $V_T$ and further according to the environment parameters $P_F$ and $P_T$. For example, if the predefined function is a cubic equation in one variable, four coefficients for the cubic term, quadratic term, linear term and constant term are defined by the coefficient $P_R$.

Figure 4B:
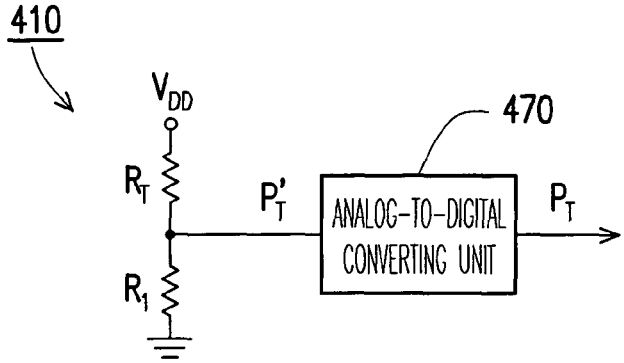
FIG. 4B is a circuit diagram of the outside environment sensor unit as shown in FIG. 4A according to an embodiment of the present invention.

FIG. 4B is a circuit diagram of the outside environment sensor unit as shown in FIG. 4A according to an embodiment of the present invention. Refer to FIGS. 4A and 4B, the outside environment sensor unit 410 includes a heat-sensitive resistor $R_T$ and a linear resistor $R_1$ connected in series between a voltage source and ground; with an electrical connection between the heat-sensitive resistor $R_T$ and the linear resistor $R_1$ output as an environment parameter $P_T'$. In addition, the outside environment sensor unit 410 further includes an analog-to-digital converting unit 470, which converts the environment parameter $P_T'$ output at the electrical connection between the heat-sensitive resistor $R_T$ and the linear resistor $R_1$ into a digital parameter $P_T$ and sends the digital parameter $P_T$ to the adjustment module 420.

Figure 5:
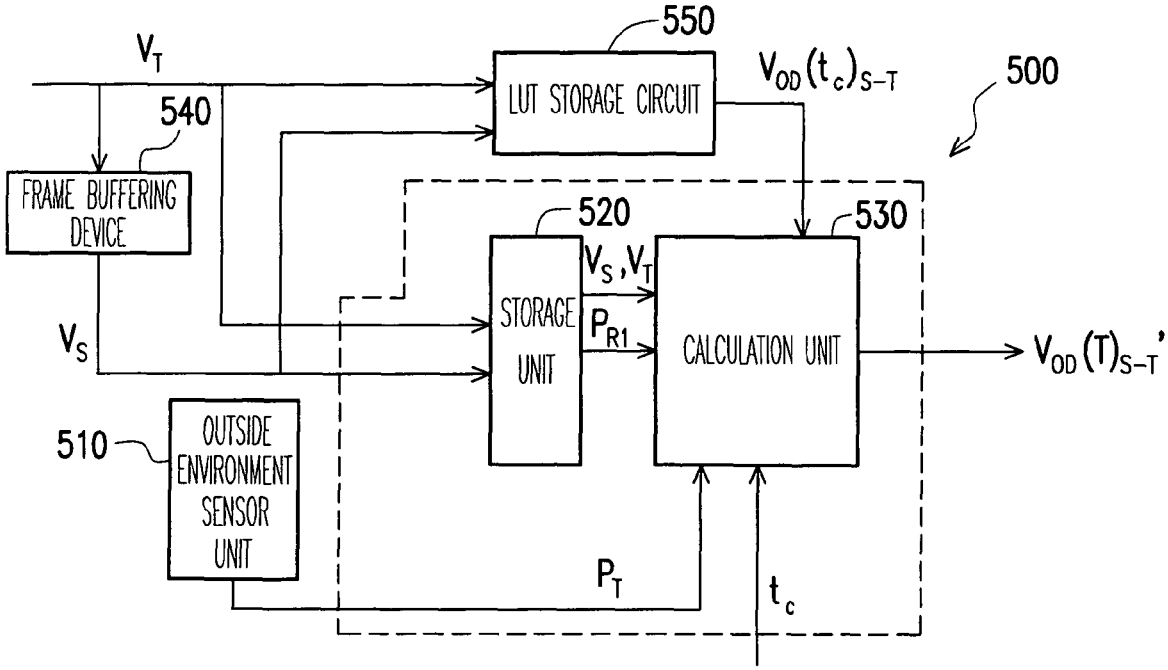
FIG. 5 is a block diagram of an apparatus for generating an overdriving value corresponding to an overdriving voltage for application to a pixel of a flat panel display when considering the temperature environment parameter according to an embodiment of the present invention.

FIG. 5 is a block diagram of an apparatus for generating an overdriving value corresponding to an overdriving voltage for application to a pixel of a flat panel display when considering the temperature environment parameter according to an embodiment of the present invention. Refer to FIG. 5, the apparatus 500 includes an outside environment sensor unit 510, a storage unit 520 and a calculation unit 530. The outside environment sensor unit 510 detects the environment temperature and provides the detected environment temperature as the environment parameter $P_T$. The storage unit 520 saves a set of coefficients for generating the modified overdriving value $V_{OD}(T)_{S-T}'$ with a predefined function.

Similar to the previous embodiment, the storage unit 520 selects a coefficient $P_{R1}$ from the set according to the initial grayscale value $V_S$ and the target grayscale value $V_T$ stored in a frame buffering device 540. The calculation unit 530 receives the coefficient $P_{R1}$ stored in the storage unit 520, substitutes the coefficient $P_{R1}$ in the predefined function and calculates the modified overdriving value $V_{OD}(T)_{S-T}'$ according to the initial grayscale value $V_S$ and the target grayscale value $V_T$ and further according to the environment parameter $P_T$.

Different from the previous embodiment, the calculation unit 530 in the embodiment produces the modified overdriving value $V_{OD}(T)_{S-T}'$ by adjusting the original overdriving value $V_{OD}(t_c)_{S-T}$ obtained from a LUT. To this end, an LUT storage circuit 550 is further provided for receiving the initial grayscale value $V_S$ and the target grayscale value $V_T$ and outputting an original overdriving value $V_{OD}(t_c)_{S-T}$ according to the initial grayscale value $V_S$ and target grayscale value $V_T$ on basis of a reference temperature $t_c$. Besides, the calculation unit 530 also takes the reference temperature $t_c$ as a calculation base for calculating a temperature change, i.e. a difference between the environment parameter $P_T$ and the reference temperature $t_c$. The initial grayscale value $V_S$ and the target grayscale value $V_T$ received by the calculation unit 530 are provided via the storage unit 520 and optionally via the frame buffering device 540. The calculation unit 530 would adjust the original overdriving value $V_{OD}(t_c)_{S-T}$ and output the modified overdriving value $V_{OD}(T)_{S-T}'$, wherein T represents a temperature converted from the environment parameter $P_T$.

The predefined function for calculating the modified overdriving value $V_{OD}(T)_{S-T}'$ may be expressed by, for example, the following equation:

$$V_{OD}(T)_{S-T}'=\Delta V_{OD}(T)_{S-T}+V_{OD}(tc)_{S-T} \quad (1)$$

wherein the modified overdriving value $V_{OD}(T)_{S-T}'$ is calculated at a temperature T when the initial grayscale value $V_S$ and the target grayscale value $V_T$ are given, which may be obtained by shifting the original overdriving value $V_{OD}(t_c)_{S-T}$ by an overdriving compensation $\Delta V_{OD}(T)_{S-T}$ which may be expressed by, for example, the following equation:

$$V_{OD}(T)_{S-T}'=a1_{S-T}*(T-tc)^3+b1_{S-T}*(T-tc)^2+c1_{S-T}*(T-tc)+V_{OD}(tc)_{S-T} \quad (2)$$

wherein the overdriving compensation $\Delta V_{OD}(T)_{S-T}$ in the equation (1) is substituted by a cubic function of an argument $(T-t_c)$ where $t_c$ is the reference temperature and $a1_{S-T}$, $b1_{S-T}$ and $c1_{S-T}$ are coefficients for the cubic function when the initial grayscale value $V_S$ and the target grayscale value $V_T$ are given. Thus, the modified overdriving value $V_{OD}(T)_{S-T}'$ for the temperature T can be obtained from equation (2).

Anyone skilled in the art is allowed to use other approaches or predefined functions to obtain the modified overdriving value $V_{OD}(T)_{S-T}'$ without departing from the scope or spirit of the invention. For example, by directly multiplying the original overdriving value $V_{OD}(t_c)_{S-T}$ by the coefficient $P_{R1}$, the modified overdriving value $V_{OD}(T)_{S-T}'$ can be obtained as well. Therefore, the present invention is not limited to the specified function describe above.

Figure 6:
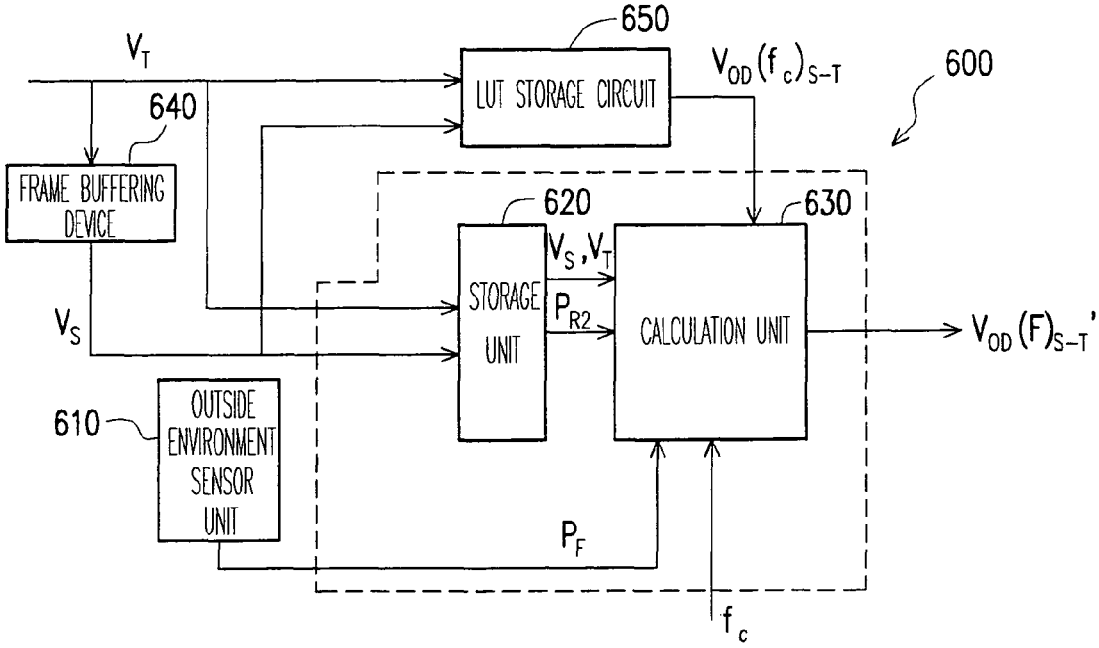
FIG. 6 is a block diagram of an apparatus for generating an overdriving value corresponding to an overdriving voltage for application to a pixel of a flat panel display when considering the frame-rate environment parameter according to an embodiment of the present invention.

FIG. 6 is a block diagram of an apparatus for generating an overdriving value corresponding to an overdriving voltage for application to a pixel of a flat panel display where considering the frame-rate environment parameter according to an embodiment of the present invention. Refer to FIG. 6, the apparatus 600 includes an outside environment sensor unit 610, a storage unit 620 and a calculation unit 630. The outside environment sensor unit 610 detects the frame rate and provides the detected frame rate as the environment parameter $P_F$. The storage unit 620 saves a set of coefficients for generating the modified overdriving value $V_{OD}(F)_{S-T}'$.

The apparatus 600 further includes a frame buffering device 640 for saving initial grayscale value $V_S$. The storage unit 620 selects a coefficient $P_{R2}$ from the set according to the initial grayscale value $V_S$ and the target grayscale value $V_T$ stored in the frame buffering device 640. The calculation unit 630 receives the coefficient $P_{R2}$ stored in the storage unit 620 and substitutes the coefficient $P_{R2}$ in a predefined function, and calculates the modified overdriving value $V_{OD}(F)_{S-T}'$ according to the initial grayscale value $V_S$ and the target grayscale value $V_T$ and further according to the environment parameter $P_F$, wherein F represents a frame rate converted by the environment parameter $P_F$.

In the embodiment, the modified overdriving value $V_{OD}(F)_{S-T}'$ is produced by the calculation unit 630 by adjusting the original overdriving value $V_{OD}(f_c)_{S-T}$ obtained from a LUT. To this end, an LUT storage circuit 650 is further provided for receiving the initial grayscale value $V_S$ and the target grayscale value VT and outputting an original overdriving value $V_{OD}(f_c)_{S-T}$ according to the initial grayscale value $V_S$ and target grayscale value $V_T$ on basis of a reference frame rate $f_c$. Besides, the calculation unit 630 also takes the reference frame rate $f_c$ as a calculation base for calculating a frame-rate change, i.e. a difference between the environment parameter $P_F$ and the reference frame rate $f_c$. The initial grayscale value $V_S$ and the target grayscale value $V_T$ received by the calculation unit 630 are via the storage unit 620 and optionally via the frame buffering device 640. The calculation unit 630 would adjust the original overdriving value $V_{OD}(f_c)_{S-T}$ and output the modified overdriving value $V_{OD}(F)_{S-T}'$.

The predefined function for calculating the adjustment overdriving value $V_{OD}(F)_{S-T}'$ may be expressed by, for example, the following equation:

$$V_{OD}(F)_{S-T}'=\Delta V_{OD}(F)_{S-T}+V_{OD}(fc)_{S-T} \tag{3}$$

wherein the modified overdriving value $V_{OD}(F)_{S-T}'$ is calculated at a frame rate F when the initial grayscale value $V_S$ and the target grayscale value $V_T$ are given, which may be obtained by shifting the original overdriving value $V_{OD}(f_c)_{S-T}$ by an overdriving compensation $\Delta V_{OD}(F)_{S-T}$ which may be expressed by, for example, the following equation:

$$V_{OD}(F)_{S-T}'=a2_{S-T}*(F-fc)^3+b2_{S-T}*(F-f_c)^2+c2_{S-T}*(F-fc)+V_{OD}(fc)_{S-T} \tag{4}$$

wherein the overdriving compensation $\Delta V_{OD}(F)_{S-T}$ in the equation (3) is substituted by a cubic function of an argument $(F-f_c)$ where $f_c$ is the reference frame rate and $a2_{S-T}$, $b2_{S-T}$ and $c2_{S-T}$ are coefficients for the cubic function when the initial grayscale value $V_S$ and the target grayscale value $V_T$ are given. Thus, the modified overdriving value $V_{OD}(F)_{S-T}'$ for the frame rate F can be obtained from the equation (4).

Anyone skilled in the art is also able to take other approaches or predefined functions to obtain the modified overdriving value $V_{OD}(F)_{S-T}'$ without departing from the scope or spirit of the invention. For example, by directly multiplying the original overdriving value $V_{OD}(f_c)_{S-T}$ by the coefficient $P_{R2}$, the modified overdriving value $V_{OD}(F)_{S-T}'$ can be obtained as well. Therefore, the present invention is not limited to the specified function describe above.

Figure 7:
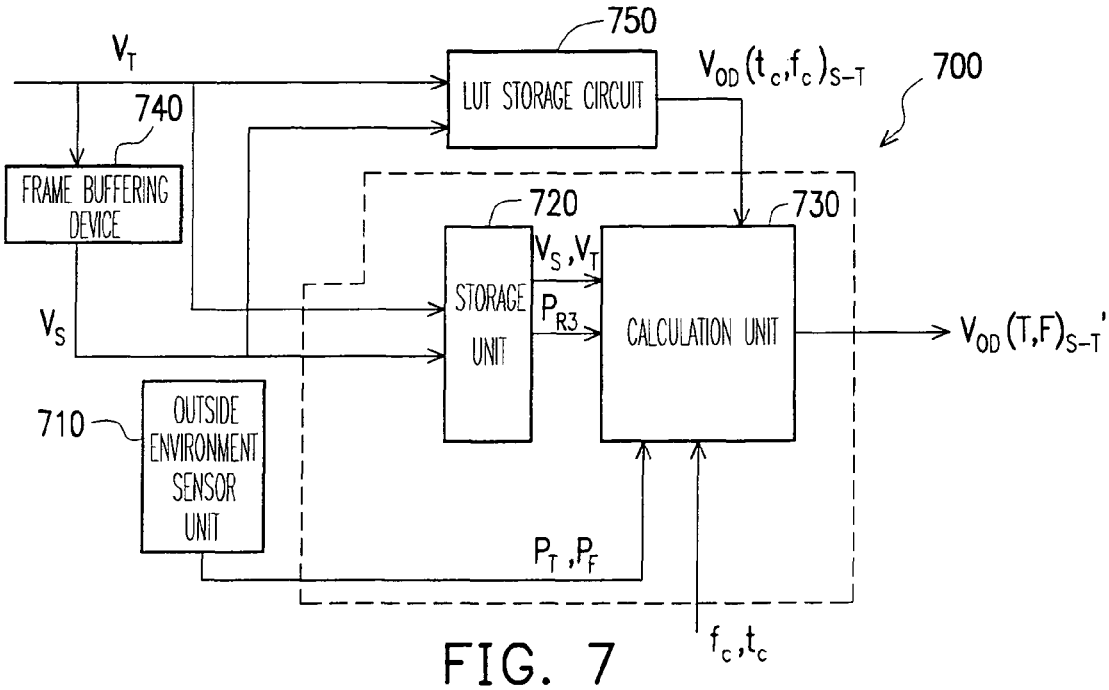
FIG. 7 is a block diagram of an apparatus for generating an overdriving value corresponding to an overdriving voltage for application to a pixel of a flat panel display when considering both of the temperature and frame rate according to an embodiment of the present invention.

FIG. 7 is a block diagram of an apparatus for generating an overdriving value corresponding to an overdriving voltage for application to a pixel of a flat panel display when considering both temperature and frame rate according to an embodiment of the present invention. Refer to FIG. 7, the apparatus 700 includes an outside environment sensor unit 710, a storage unit 720 and a calculation unit 730. The outside environment sensor unit 710 detects the temperature and the frame rate and provides the detected temperature and frame rate as two environment parameters $P_T$ and $P_F$. The storage unit 720 saves a set of coefficients for generating the modified overdriving value $V_{OD}(F)_{S-T}'$, wherein T represents a temperature converted from the environment parameter $P_T$, and F represents a frame rate converted from the environment parameter $P_F$.

The storage unit 720 selects a coefficient $P_{R3}$ from the set according to the initial grayscale value $V_S$ and the target grayscale value $V_T$ stored in the frame registering device 740. The calculation unit 730 receives the coefficient $P_{R3}$ stored in the storage unit 720, substitutes the coefficient $P_{R3}$ in a predefined function, and calculates the modified overdriving value $V_{OD}(T,F)_{S-T}'$ according to the initial grayscale value $V_S$ and the target grayscale value $V_T$ and further according to both of the environment parameters $P_T$ and $P_F$.

In the embodiment, the modified overdriving value $V_{OD}(T,F)_{S-T}'$ is produced by the calculation unit 730 by adjusting the original overdriving value $V_{OD}(t_c,f_c)_{S-T}$ obtained from a LUT. To this end, an LUT storage circuit 750 is further provided for receiving the initial grayscale value $V_S$ and the target grayscale value $V_T$ and outputting an original overdriving value $V_{OD}(t_c,f_c)_{S-T}$ according to the initial grayscale value $V_S$ and target grayscale value $V_T$ on basis of a reference temperature $t_c$ and a reference frame rate $f_c$. Besides, the calculation unit 730 also takes the reference temperature $t_c$ and the reference frame rate $f_c$ as calculation bases for calculating temperature and frame-rate changes, i.e. a difference between the environment parameter $P_T$ and the reference temperature $t_c$ and a difference between the environment parameter $P_F$ and the reference frame rate $f_c$. The initial grayscale value $V_S$ and the target grayscale value $V_T$ received by the calculation unit 730 can be provided via the storage unit 720 and optionally via the frame registering device 740. The calculation unit 730 would adjust the original overdriving value $V_{OD}(t_c,f_c)_{S-T}$ and output the modified overdriving value $V_{OD}(T,F)_{S-T}'$.

The predefined function for calculating the adjustment overdriving values $V_{OD}(T,F)_{S-T}'$ may be expressed by, for example, the following equation:

$$V_{OD}(T,F)_{S-T}'=\Delta V_{OD}(T,F)_{S-T}+V_{OD}(tc,fc)_{S-T} \tag{5}$$

wherein the modified overdriving value $V_{OD}(T,F)_{S-T}'$ is calculated at a temperature T and a frame rate F when the initial grayscale value $V_S$ and the target grayscale value $V_T$ are given, which may be obtained by shifting the original overdriving value $V_{OD}(t_c,f_c)_{S-T}$ by an overdriving compensation $\Delta V_{OD}(T,F)_{S-T}$, which may be expressed by, for example, the following equation:

$$V_{OD}(T,F)_{S-T}'=a1_{S-T}*(T-tc)^3+b1_{S-T}*(T-tc)^2+c1_{S-T}*(T-tc)+a2_{S-T}*(F-fc)^3+b2_{S-T}*(F-fc)^2+c2_{S-T}*(F-fc)+V_{OD}(tc,fc)_{S-T} \tag{6}$$

wherein the overdriving compensation $\Delta V_{OD}(T,F)_{S-T}$ in the equation (5) is substituted by a cubic function of two arguments $(T-t_c)$ and $(F-f_c)$ where $t_c$ and $f_c$ represent the reference temperature and the reference frame rate, and $a1_{S-T}$, $b1_{S-T}$ and $c1_{S-T}$ and $a2_{S-T}$, $b2_{S-T}$ and $c2_{S-T}$ are coefficients for the cubic function when the initial grayscale value $V_S$ and the target grayscale value $V_T$ are given. Thus, the modified overdriving value $V_{OD}(T,F)_{S-T}'$ for the temperature T and the frame rate F can be obtained from the equation (6).

Anyone skilled in the art is also able to take other approaches or predefined functions to obtain the modified overdriving value $V_{OD}(T,F)_{S-T}'$ without departing from the scope or spirit of the invention. For example, by directly multiplying the original overdriving value $V_{OD}(t_c,f_c)_{S-T}$ by the coefficient $P_{R3}$, the modified overdriving value $V_{OD}(T,F)_{S-T}'$ can be obtained as well. Therefore, the present invention is not limited to the specified function describe above.

FIG. 8 is an LUT for finding out, for example, the coefficient $b1_{S-T}$ according to an embodiment of the present invention. FIG. 9 is an LUT with entries modified from the LUT of FIG. 8 and with a set of slopes obtained from the entries of the LUT of FIG. 8. Refer to FIGS. 8 and 9, a regression analysis is performed on entries of each column in FIG. 8, i.e. a regression analysis is performed on each target grayscale value for multiple initial grayscale values, a slope corresponding to the target grayscale value is obtained, which can be used to calculate the coefficients $b1_{S-T}$ for multiple initial grayscale values. By obtaining a set of slopes corresponding to each target grayscale value, the LUT can be effectively downsized.

Similarly, all the coefficients in the equations (1), (2) and (3), $a1_{S-T}$, $b1_{S-T}$, $c1_{S-T}$, $a2_{S-T}$, $b2_{S-T}$, $c2_{S-T}$, $a3_{S-T}$, $b3_{S-T}$ and $c3_{S-T}$, originally in form of LUTs and saved in the storage unit, may be simply replaced by a set of slopes, respectively.

In another embodiment of the present invention, refer to FIG. 4A, an adjustment module 420 includes a storage unit 430 and a calculation unit 440, wherein the storage unit 430 saves multiple sets of slopes and selects a set corresponding to the target grayscale value $V_T$. The calculation unit 440 is electrically coupled with the storage unit 430 to receive the set and to calculate coefficients required for a predefined function for adjusting the overdriving value $V_{OD}$. After that, by substituting the coefficients and the environment parameters $P_F$ and $P_T$ into the predefined function, the original overdriving value $V_{OD}$ are adjusted and the modifed overdriving value $V_{OD}'$ is output. Similarly, the original overdriving values $V_{OD}$ for each target grayscale value can be approximated by a set of slope, which further downsizes the storage requirement.

Figure 10:
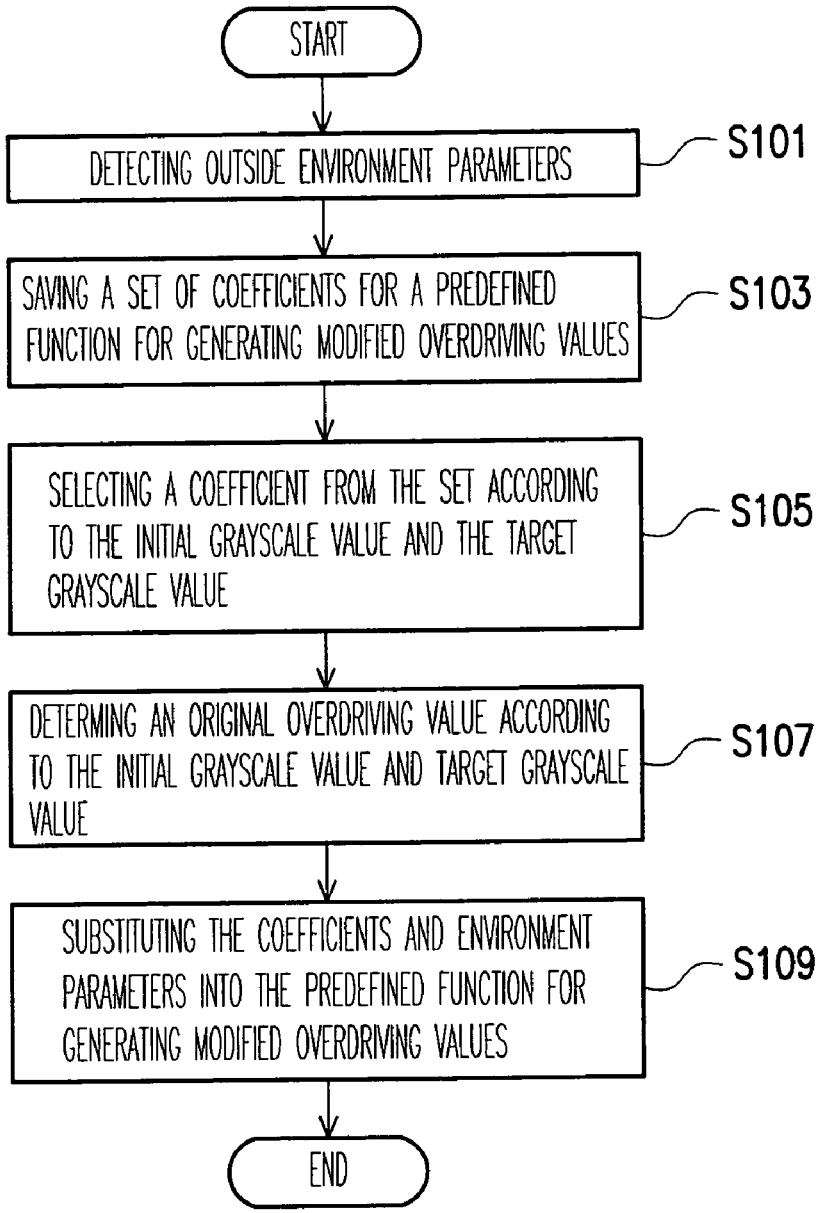
FIG. 10 is a flowchart showing a method for generating an overdriving value corresponding to an overdriving voltage for application to a pixel of a flat panel display according to an embodiment of the present invention.

FIG. 10 is a flowchart showing a method for generating an overdriving value corresponding to an overdriving voltage for application to a pixel of a flat panel display according to an embodiment of the present invention. Refer to FIGS. 4A and 10, the method includes the following steps. First, in step S101, an outside environment sensor unit 410 detects the environment parameters $P_F$ and $P_T$. Next, in step S103, a storage unit 430 saves a set of coefficient for use in a predefined function for adjusting the original overdriving value. Afterwards, in step S105, the storage unit 430 select a coefficient $P_R$ from the set when an initial grayscale value $V_S$ and a target grayscale value $V_T$ are given. Further, in step S107, an original overdriving value is determined according to the initial grayscale value $V_S$ and the target grayscale value $V_T$. Finally, in step S109, substitute the coefficients $P_R$ and the environment parameters $P_F$ and $P_T$ into the predefined function for generating the modified overdriving value $V_{OD}'$, wherein the environment parameters include at least one of frame rate and temperature.

Figure 11:
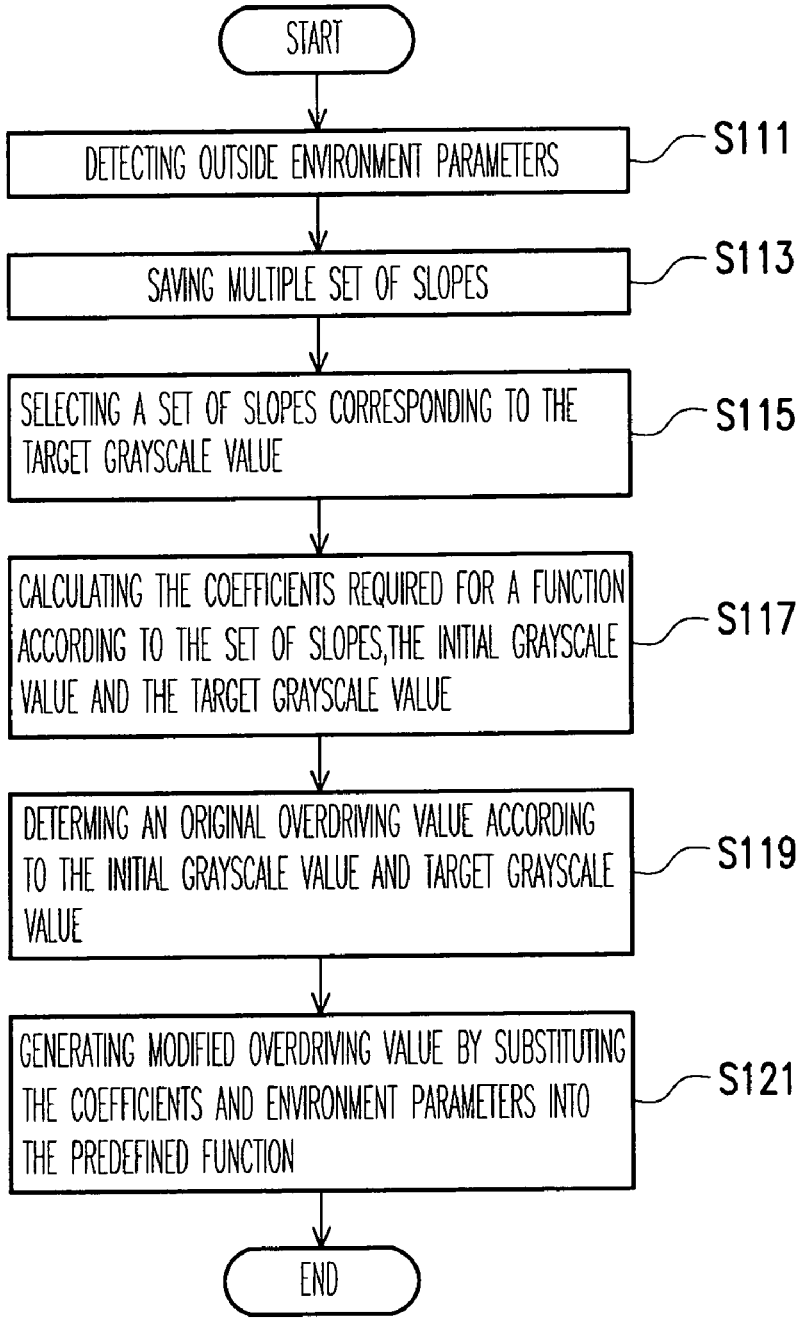
FIG. 11 is a flowchart showing a method for generating and overdriving value corresponding to an overdriving voltage for application to a pixel of a flat panel display according to another embodiment of the present invention.

FIG. 11 is a flowchart showing a method for generating an overdriving value corresponding to an overdriving voltage for application to a pixel of a flat panel display according to another embodiment of the present invention. Refer to FIGS. 4A and 11, the method includes the following steps. First, in step S111, an outside environment sensor unit 410 detects the environment parameters $P_F$ and $P_T$. Next, in step S113, a storage unit 430 saves multiple sets of slopes. Afterwards, in step S115, a set of slopes is selected corresponding to a target grayscale value. Further, in step S117, calculate coefficients $P_R$ required for a predefined function for adjusting the original overdriving values according to the set of slopes, an initial grayscale value and a target grayscale value. Furthermore, in step 119, an original overdrive value is determined according to the initial grayscale value and the target grayscale value. Finally, in step S121, substitute the coefficients $P_R$ and the environment parameters $P_F$ and $P_T$ into the predefined function for adjusting the original overdriving value to generate an overdriving value $V_{OD}'$, wherein the environment parameters include at least one of the frame rate and temperature.

In summary, the present invention considers the frame rate and the temperature as the environment parameters to further adjust the original overdriving values. Therefore, the present invention enables a flat panel display to have higher-precision overdriving values even at a varying frame rate and/or temperature, which effectively improves the display quality.

Further, the present invention uses multiple sets of slopes to downsize multiple LUTs, which saves a lot of memory spaces and lowers the production cost.

It will be apparent to those skilled in the art that various modifications and variations can be made to the structure of the present invention without departing from the scope or spirit of the invention. In view of the foregoing, it is intended that the specification and examples to be considered as exemplary only, with a true scope and spirit of the invention being indicated by the following claims and their equivalents.

What is claimed is:

1. An apparatus for generating a modified overdriving value corresponding to a modified overdriving voltage for application to a pixel of a flat panel display, the apparatus comprising:

an outside environment sensor unit for detecting at least an environment parameter, the outside environment sensor unit having a heat-sensitive resistor, a linear resistor, and an analog-to-digital converting unit, wherein the heat-sensitive resistor and the linear resistor are connected in series between a voltage source and ground, with a temperature in analog form output at the electrical connection between the heat-sensitive resistor and the linear resistor, and the temperature in analog form is converted into a temperature in digital form; and an adjustment module, electrically coupled with the outside environment sensor unit, receiving an initial grayscale value and a target grayscale value of the pixel and generating the modified overdriving value according to the initial grayscale value and the target grayscale value and further according to the environment parameter transmitted thereto in digital form by the outside environment sensor unit, the adjustment module comprising:

a storage unit for saving multiple sets of slopes and selecting a set of slopes according to the target grayscale value, wherein each set of slopes is obtained by a regression analysis of the target grayscale value and the initial grayscale value; and a calculation unit, electrically coupled with the storage unit for receiving the selected set of slopes, calculating coefficients required for the predefined function according to the selected set of slopes, the initial grayscale value and the target grayscale value, receiving the environment parameter, and substituting the coefficients and the environment parameter into the predefined function to generate the modified overdriving value.

2. The apparatus for generating a modified overdriving value as recited in claim 1, wherein the environment parameter comprises a frame rate.

3. The apparatus for generating a modified overdriving value as recited in claim 1, wherein the environment parameter comprises a temperature.

4. The apparatus for generating a modified overdriving value as recited in claim 1, wherein the environment parameter comprises a frame rate and a temperature.

5. The apparatus for generating a modified overdriving value as recited in claim 1, further comprising a LUT storage circuit for receiving the initial grayscale value and the target grayscale value and outputting an original driving value according to the initial grayscale value and the target grayscale value, wherein the calculation unit substitutes the original driving value together with the coefficients and the environment parameter into the specific function to generate the modified overdriving value.

6. A method for generating a modified overdriving value corresponding to an modified overdriving voltage for application to a pixel of a flat panel display, comprising:

detecting at least an environment parameter of the outside environment; and determining the modified overdriving value according to an initial grayscale value and a target grayscale value of the pixel and further according to the environment parameter, wherein determining the modified overdriving value further comprises:

saving a plurality of sets of slopes, wherein each set of slopes is obtained by a regression analysis of the target grayscale value and the initial grayscale value;

selecting a set of slopes corresponding to the target grayscale value;

calculating coefficients required for a predefined function for generating the modified overdriving value according to the set of slopes, the initial grayscale value and the target grayscale value; and substituting the coefficients and the environment parameter into the predefined function to generate the modified overdriving value.

7. The method for generating a modified overdriving value as recited in claim 6, wherein the environment parameter comprises a frame rate.

8. The method for generating a modified overdriving value as recited in claim 6, wherein the environment parameter comprises a temperature.

9. The method for generating a modified overdriving value as recited in claim 6, wherein the environment parameter comprises a frame rate and a temperature.

10. The method for generating a modified overdriving value as recited in claim 6, wherein the step for substituting the coefficients and the environment parameter into the predefined function to generate the modified overdriving value comprises:

determining an original overdriving value according to the initial grayscale value and the target grayscale value; and substituting the coefficients and the environment parameter into the predefined function to adjust the original overdriving value, so as to generate the modified overdriving value.

* * * * *